US010726759B2

(12) United States Patent
VanderWel

(10) Patent No.: US 10,726,759 B2
(45) Date of Patent: Jul. 28, 2020

(54) COLOR MODIFICATION SYSTEM AND METHODS FOR VEHICLE DISPLAYS

(71) Applicant: GENTEX CORPORATION, Zeeland, MI (US)

(72) Inventor: Peter Wm. VanderWel, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 16/004,910

(22) Filed: Jun. 11, 2018

(65) Prior Publication Data

US 2019/0378449 A1 Dec. 12, 2019

(51) Int. Cl.
*G09G 3/20* (2006.01)
*G09G 5/02* (2006.01)

(52) U.S. Cl.
CPC ... *G09G 3/2003* (2013.01); *G09G 2320/0666* (2013.01); *G09G 2354/00* (2013.01)

(58) Field of Classification Search
CPC ..... G09G 3/2003; G09G 5/02
See application file for complete search history.

(56) References Cited

U.S. PATENT DOCUMENTS

2003/0095705 A1 5/2003 Weast
2006/0061586 A1 3/2006 Brulle-Drews et al.
2007/0236656 A1* 10/2007 Jeong ..... H04N 9/68 351/159.24
2009/0015736 A1 1/2009 Weller et al.
2011/0229023 A1 9/2011 Jones et al.
2014/0285666 A1* 9/2014 O'Connell ..... B60R 1/12 348/148
2016/0267335 A1* 9/2016 Hampiholi ..... G06F 3/013
2016/0370586 A1* 12/2016 Saenger Nayver ..... G02B 5/23
2017/0176753 A1* 6/2017 Shi ..... G02F 1/1362

OTHER PUBLICATIONS

International Search Report dated Sep. 12, 2019, for corresponding PCT application No. US2019/035151, 3 pages.
Written Opinion of the International Searching Authority dated Sep. 12, 2019, for corresponding PCT application No. US2019/035151, 6 pages.

* cited by examiner

*Primary Examiner* — Yi Yang
(74) *Attorney, Agent, or Firm* — Price Heneveld LLP; Bradley D. Johnson

(57) ABSTRACT

According to one aspect, a color modification system for displays in vehicles may comprise a display module comprising a display element capable of displaying color images; an image processing system; and a user identification system in communication with the image processing system; the image processing system may be capable of selectively modifying the colors of the images. The image processing system may be in communication with the display module. The user identification system may be capable of providing inputs to the image processing system; and the image processing system may be capable of selectively modifying the colors of the color images based on inputs received from the user identification system. The system may further comprise at least one imager capable of capturing color images and to transmit the color images to the image processing system.

7 Claims, 6 Drawing Sheets

COLOR MODIFICATION SYSTEM AND METHODS FOR VEHICLE DISPLAYS

FIELD OF THE DISCLOSURE

This disclosure relates generally to processing of displays to be shown on vehicle display assemblies, and in particular, to selectively adjusting the colors of the display.

BACKGROUND

Color blindness affects up to ten percent of males and up to 0.5 percent of females or, according to some estimates, up to 300 million people worldwide. There is no cure for color blindness. There are several different types of color blindness, and each different type may be unable to distinguish different colors or groups of colors. Additionally, there may be different intensities of color blindness, with some color blind people having color perception that is impaired to a greater extent than others.

Displays in vehicles, including those in rearview mirror or rearview display assemblies, infotainment consoles, and even heads up displays, may pose special difficulties for color blind people. Since the display screen may be relatively small, it may be somewhat more difficult for any user to distinguish details of a scene displayed on the device. For those with color blindness, there may not be as much contrast or variety in the colors in the displayed scene, which may make it more difficult to distinguish details of the displayed scene.

SUMMARY

According to one aspect, a color modification system for displays in vehicles may comprise a display module comprising a display element capable of displaying color images; an image processing system; and a user identification system in communication with the image processing system; the image processing system may be capable of selectively modifying the colors of the images. The image processing system may be in communication with the display module. The user identification system may be capable of providing inputs to the image processing system; and the image processing system may be capable of selectively modifying the colors of the color images based on inputs received from the user identification system. The system may further comprise at least one imager capable of capturing color images and to transmit the color images to the image processing system. The system may further comprise a display assembly having a housing; display module may be at least partially housed in the housing; and display assembly may be one of a rearview assembly, an infotainment console, and a heads up display system. The rearview assembly may further comprise an electro-optic element disposed between the display element and the user; the image processing system may be in communication with the electro-optic element; and the image processing system may be capable of selectively applying additional modifications to images upon receiving inputs indicating that the electro-optic element has been activated. The system may further comprise a projector in communication with the image processing system; wherein the display element may comprise a combiner screen; and wherein the projector may be capable of projecting the images onto the combiner screen. The user identification system may comprise a processor and user identification element; wherein the user identification system may be capable of storing at least one user profile; and wherein the user identification element may comprise at least one of an item controlled by a user and linked to the vehicle, a biometric recognition system, and a user interface system. The system may further comprise at least a second display module may comprise at least a second display element; wherein the at least a second display module may be in communication with the image processing system; wherein the user identification system may be capable of providing inputs to the image processing system; and wherein the image processing system may be capable of selectively modifying the colors of the images based on inputs received from the user identification system.

According to an aspect, a method for adjusting colors on vehicle displays may comprise providing a color modification system comprising a display module comprising a display element capable of displaying color images, an image processing system in communication with the display module, an imager capable of capturing color images and to transmit the images to the image processing system, a user identification system in communication with the image processing system, at least one stored user profile linked with a particular user's input from the user identification system, and at least one stored color modification regime linked to one of the at least one stored user profiles; receiving an input from the user identification system, comparing the input from the user identification system with stored user profiles; and determining whether the input may be linked with a stored user profile that may be linked to one of the at least one stored color modification regimes. The method may further comprise the steps of accessing the stored color modification regime linked to the input from the user identification system and applying the color modification regime to images displayed on display element. The display module may be part of a display assembly; wherein the display assembly may comprise an electro-optic element; and the method may further comprise the step of determining whether the electro-optic element has been activated. The method may further comprise the step of applying additional modifications to the colors and color intensities of the images to compensate for color changes caused by the electro-optic element. The method may further comprise the step of reverting to displaying images with unmodified colors upon the occurrence of a terminating event.

According to an aspect, a method for training a color modification system for modifying color hues and intensities of images displayed in vehicle systems may comprise: providing a color modification system comprising a display assembly comprising a user interface and a display module having a display element capable of displaying color images, an image processing system in communication with the display module, an imager capable of capturing color images and to transmit the images to the image processing system, and a user identification system in communication with the image processing system; receiving at least one user identification input through the user identification system; linking the user identification input with a new user profile; storing the new user profile in the color modification system; displaying a plurality of images on the display element for the user to select through the user interface; and receiving at least one user input through the user interface. The method may further comprise the step of determining whether the color modification system has received sufficient user inputs through the user interface to determine an appropriate color modification regime to apply to displayed images linked to the new user profile. The color modification system may further comprise a plurality of stored color modification regimes; the method may further comprise the steps of selecting an appropriate stored color modification regime based on the received user inputs; and linking the selected color modification regime with the new user profile. The method may further comprise the steps of receiving an input from the user identification system linked to the stored new user profile; and applying the stored color modification regime to displayed images. The method may further comprise the steps of developing a custom color modification regime based on inputs received from the user interface; and linking the custom color modification regime with the new user profile. The method may further comprise the step of applying the custom color modification regime to displayed images upon receipt of an input from the user identification system that may be linked to the new user profile.

DETAILED DESCRIPTION

The present disclosure relates to a color modification system for displaying selectively modified video images onto at least one display assembly of a vehicle. The color modification system may comprise an imager which may capture images of a desired scene for display on the at least one vehicle display assembly. The display assembly may be, for example, interior or exterior rearview display assemblies or mirror assemblies, heads up display systems, and infotainment console screens. The color modification system may alter or modify the hues or intensities of colors of images displayed in display assemblies. The modified displayed images may have color characteristics specific to a particular user. The modifications may be applied to the entire image or only to those pixels that are of certain colors or hues. The modified characteristics of the displayed image may make it easier for some users, particularly color blind users, to view and visually process the images, and to distinguish different elements in the displayed images.

There are different types and degrees of color blindness so a single color modification regime will not work for all color blind users. The color modification system may adjust the hues and their intensities based on a user's individual needs. The color modification system may link a specific color modification regime with a particular user. A user may initially train the color modification system to display images based on the type and degree of the user's color blindness. In some embodiments, a user may initially select from a collection of predetermined correction regimes that may be stored in the color modification system, choosing one that best allows the user to distinguish the widest variety of colors. In some embodiments, a user may provide input to the system that leads to the development of a custom color modification regime. Once color modification system 10 has been trained, and has either chosen an appropriate correction regime or customized a color modification system to the user's requirements, color modification system may recognize the user each time the user enters the vehicle, and may apply the appropriate modifications to the vehicle display systems. In some embodiments, color modification system may apply the modifications to a plurality of display assemblies associated with the vehicle, such as interior and exterior rearview display mirror assemblies or rearview display assemblies, heads up display systems, and infotainment consoles. In some embodiments, a user may only need to initially train color modification system 10 on a single device associated with the vehicle, and the vehicle may then apply the appropriate color correction regimes to all appropriate devices.

Figure 1A:
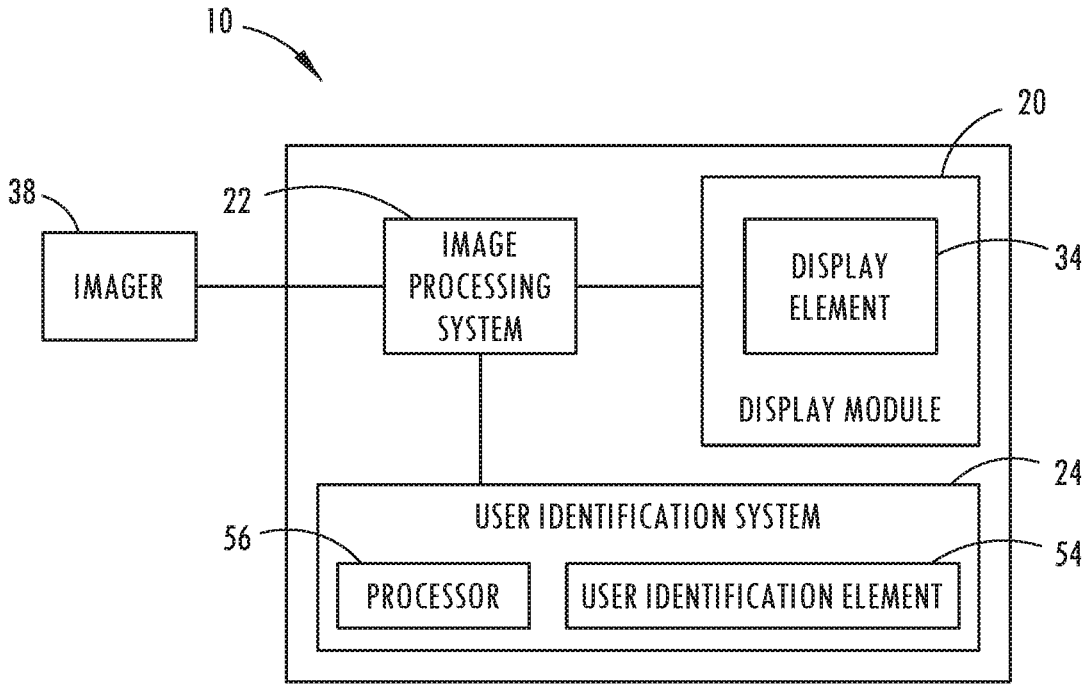
FIG. 1A shows a schematic representation of an embodiment of a color modification system for a vehicle in accordance with this disclosure.
Figure 1B:
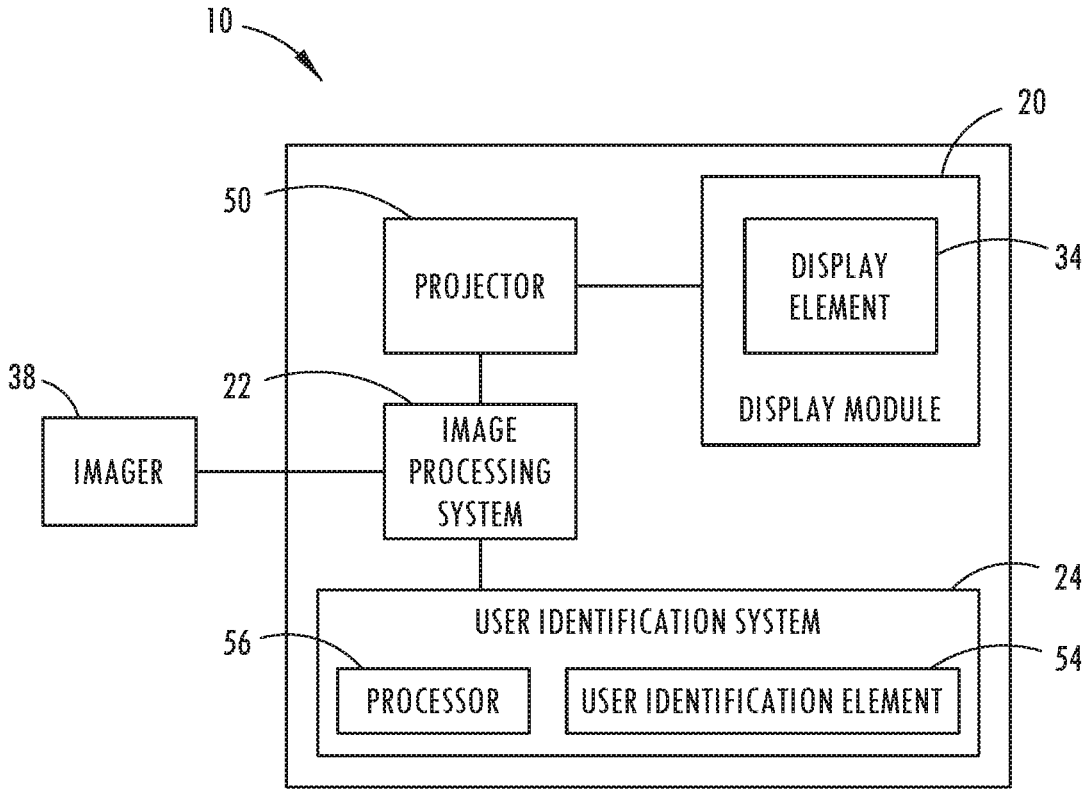
FIG. 1B shows a schematic representation of an embodiment of the color modification system for a vehicle in accordance with this disclosure.
Figure 2:
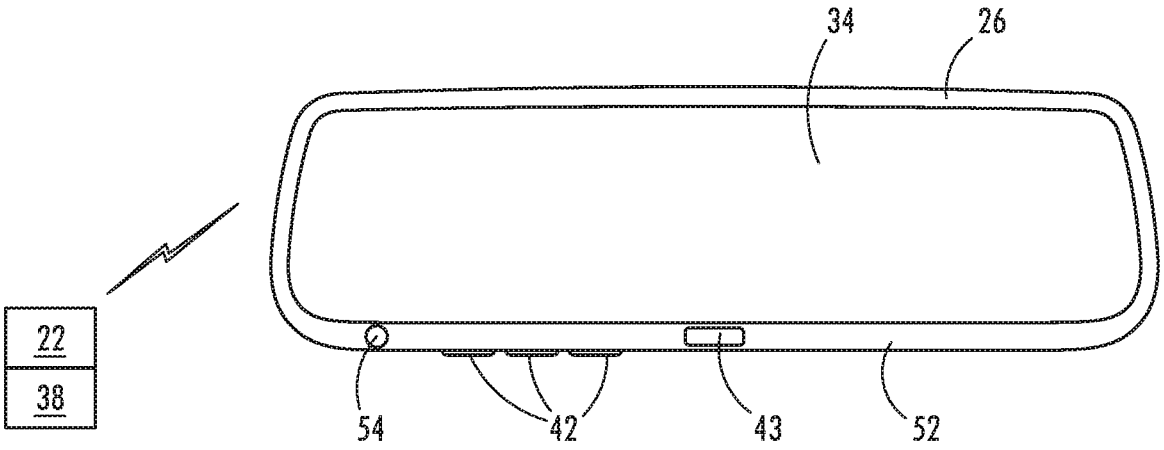
FIG. 2 illustrates a front view of the color modification system disposed in a rearview assembly in accordance with an embodiment of this disclosure.

Referring now to the figures, FIGS. 1A and 1B show block diagrams of examples of a color modification system. The color modification system, shown generally at 10, comprises a display module 20, an image processing system 22, and a user identification system 24. Display module 20 may comprise a display element 34 and, in some embodiments, a printed circuit board (PCB) 36. In some embodiments, display module 20 may be at least partially housed in a display assembly 26. The at least one display assembly 26 may be at least one of a rearview display assembly 28 on the exterior of the vehicle, a rearview display assembly 28 on the interior of the vehicle, a heads up display system 30 in the vehicle's interior, an infotainment console 32 in a vehicle, and any other display element 34 in any suitable location in the interior of or associated with the vehicle.

In some embodiments, color modification system 10 may also comprise at least one camera or other imager 38. Imager 38 may be any conventional camera or imaging system. Imager 38 may be operative to view and capture an image of a desired scene. In some embodiments, imager 38 may capture images of the desired view, convert the captured images to digital signals, and transmit the digital signals to image processing system 22.

Figure 6:
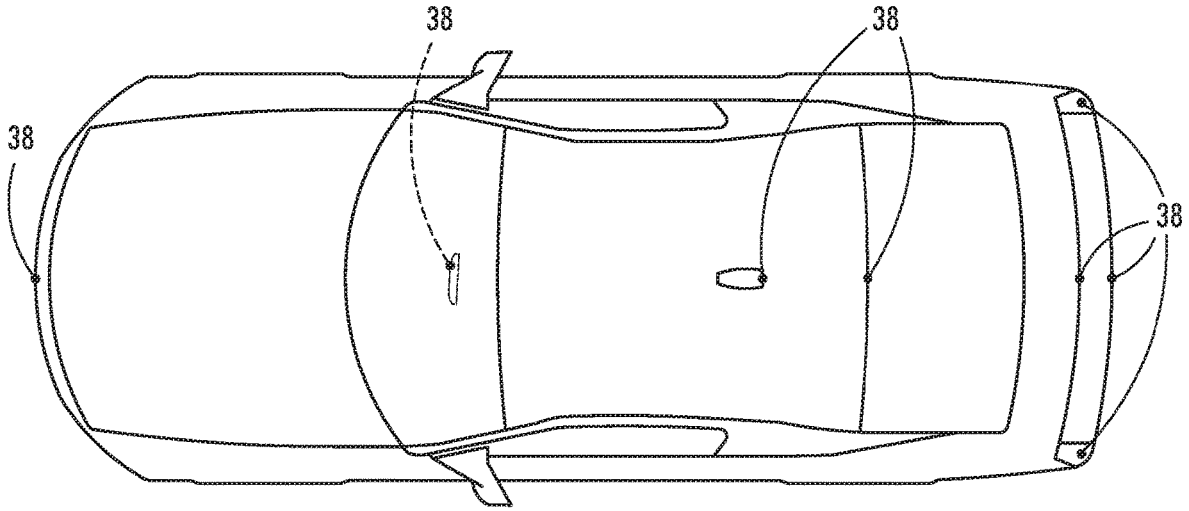
FIG. 6 is a plan view showing alternative locations for the imager.

Imager 38 may be disposed in the interior or on the exterior of the vehicle in any suitable location that would allow it to collect images of a desired location or region relative to the vehicle. For example, as shown in FIG. 6, imager 38 may be mounted in a variety of locations including, but not limited to, one of the vehicle's rearview display assemblies, a "shark fin" mounted on the exterior roof of the vehicle, a front or rear bumper, behind a rear window, in a license plate frame, in a housing of an exterior display element 34, in a tail light(s) or a center high-mounted stop light (CHMSL) assembly, or provided as an integral component such as, but not limited to, behind a rear window as disclosed in U.S. Pat. No. 6,550,949 or inside a rearview assembly 28 as disclosed in U.S. Pat. No. 6,611,610, the entire disclosures of which are incorporated herein by reference. Imager 38 may be oriented in a variety of ways to view scenes at various locations in or around the vehicle, and the scenes may be of areas outside or inside the vehicle. Thus, the desired scene may include, but is not limited to, the sides, back, front, bottom, top, and inside of the vehicle.

Image processing system 22 may be capable of receiving signals from imager 38 and inputs from user identification system 24, and may apply a color modification regime to images received from imager 38 based on the inputs received from user identification system 24. Image processing system 22 may also be capable of transmitting modified images to display module 20 for display on display element 34. Color modification regime may comprise a template for colors, color ranges or color intensities to be altered, and the colors, color ranges, or color intensities to which they should be altered. Upon receipt of the images, image processing system 22 may alter or modify the image or aspects of the image. In some embodiments, some image processing may occur in imager 38, and imager 38 may shift or modify at least some of the hues and color intensities in the captured image. Image processing system 22 may then transmit the modified images to at least one display module 20 for display on at least one associated display element 34. Thus, the color-modified hues and intensities may appear in the displayed image as different colors or as having different color intensities. The modified colors or intensities may better allow color blind users to distinguish them, thereby allowing them to better perceive and visually process the displayed images.

In some embodiments, image processing system 22 may have multiple components, and some components may be wholly or partially incorporated with imager 38 or with display module 20, split between imager 38 and display module 20, or provided separate from imager 38 and display module 20. Other components may be disposed in other locations within the vehicle; for example, within rearview assembly 28, a mounting element 46 for rearview assembly 28, vehicle infotainment console 32, a heads-up display system 30, a pillar, a headliner, a vehicle dashboard, an instrument panel, a infotainment console 32, and a visor of a motor vehicle.

Communication between the various components of color modification system 10 may be by any one combination of wired, wireless, analog, digital, and fiber optic means.

While image processing system 22 may be capable of receiving input from imager 38, it is to be understood that image processing system 22 may receive input from other devices that are not shown herein such as, but not limited to, rain sensor(s), light sensor(s), automatic vehicle exterior light controller(s), global positioning systems, tele-communication systems, and a host of other devices, and display module 20 may provide appropriate visual notifications and/or automatically manipulate other devices and systems based on the received inputs.

Referring now to FIG. 1B, in some embodiments, color modification system 10 may further comprise a projector 50. Projector 50 may be in communication with image processing system 22, and may receive images therefrom. Projector 50 may be positioned to project the received images to a display element 34, such as a combiner screen 40 in a heads up display system 30, to be displayed thereon. The projected images may include graphics, such as lane markers, current speed, or location. The graphics may be generated by image processing system 22. Images projected by projector 50 may be color-modified in the same manner as images displayed on rearview assembly 28 or infotainment console 32.

User identification system 24 of image processing system 10 may comprise a processor 56 and a user identification element 54. Processor 56 may have stored user profiles for at least one user, and the stored user profiles may include settings for various components of the vehicle that are specific to the associated user. For example, the settings may include information for such things as seat position settings and mirror orientation. In some embodiments, the settings may also include instructions regarding whether image processing system 22 should apply a color modification regime to displayed images to correct for the user's color blindness.

User identification system 24 may receive inputs from user identification element 54. The inputs may include identifying data for a user. User identification system 24 may identify a particular user by comparing the received identifying data with stored user profiles. If a stored profile matches the input, the user's stored user profile may be accessed.

User identification system 24 may provide input to image processing system 22. Input may include information on whether color modification instructions are associated with the current user's stored profile. If the user's stored profile is associated with color modification instructions, user identification system 24 may transmit instructions on applying the appropriate color modification regime. The applied modification regime is the one chosen by or developed by color modification system 10 when the user initially set the system up. Upon receipt of the instructions, color modification system 10 may access the appropriate color modification regime and apply the regime to images displayed on display elements 34 associated with the vehicle.

In some embodiments, the user identification element 54 may be an item controlled by a user and linked to a vehicle such as, for example, a key fob that has a user recognition feature. In some embodiments, the key fob may store information, such as whether a color modification regime is linked to the user of the key fob. Upon activation of color modification system 10, key fob may communicate certain user information, including information on a user profile associated with the key fob, to color modification system. The information may be received by user identification system 24, and appropriate instructions on applying any color adjustment regime linked to the user of the key fob may be transmitted to image processing system 22. Image processing system 22, in turn, may adjust the colors of any display in accordance with the instructions. In some embodiments, certain systems associated with the vehicle may also detect the presence of the key fob or other item controlled by a particular user, and may access stored instructions on, for example, seat settings and mirror orientation settings for the user associated with the particular key fob.

In some embodiments, user identification element 54 may be capable of capturing biometric identification data. Biometric data may include at least one of iris recognition, fingerprint recognition, voice recognition, face and/or body recognition, and any other biometric information that may be captured. The biometric data may be captured and may be linked with a particular user's profile in user identification system 24. The user's profile, including any linked color modification regimes, may be communicated to image processing system 22.

When the biometric data includes fingerprint recognition, a sensor 43 may be capable of capturing a user's fingerprint, and may be in communication with processor 56 in user identification system 24. Sensor may be disposed, for example, on a viewing surface of rearview display assembly 28, on a lip 52 or bezel of rearview display assembly 28, or within a vehicle's infotainment console 32. Any stored color modification regimes may be linked with user identification system 24 to a particular fingerprint. The captured fingerprint may be compared to any stored fingerprints. If the captured fingerprint matches any stored fingerprints, the user identification system may access the stored user profile linked with the matching stored fingerprint to ascertain whether any color modification regimes are linked with and should be applied to displayed images.

In cases in which the biometric data includes iris recognition, facial recognition, or body recognition, a second camera or other imager (not shown), capable of collecting appropriate biometric data, may be disposed in a location in which it can capture the relevant biometric information. This location may be, for example, in lip 52 or bezel of a housing 44 of a rearview assembly 28 or behind display element 34 of a rearview assembly 28. Similar to fingerprint recognition, the biometric data may be collected and compared with stored biometric data to determine whether the user has a stored user profile in color modification system 10. If it is determined that color modification system 10 has a stored user profile for the particular user and that the stored user profile is associated with a color modification regime, image processing system 22 may apply the color modification regime, processing any displayed images as appropriate to change at least some colors or color ranges according to the stored instructions.

In cases in which the biometric data includes voice recognition, a microphone may be disposed to be in communication with processor 56. Microphone may be disposed in a location in which it may capture a user's voice, such as in a lip 52 of housing 44 of rearview display assembly 28, in a vehicle dashboard, or in an infotainment console 32. Microphone may collect biometric data and communicate it to user identification system 24, where it may be compared with any stored voice profiles. The voice data may be matched with voice profiles to determine, among other things, whether any color modification regimes need to be made to displayed images.

In some embodiments, user identification element 54 may comprise a user interface that allows user input. User interface may comprise, for example, buttons, toggles, or capacitive touch sensors 42. The buttons or capacitive touch sensors 42 may be disposed in an infotainment console 32, on a rearview display assembly 28, on an exterior door of the vehicle, on a pillar of the vehicle, or other suitable location in the vehicle. In some embodiments, user identification may be done by entering a password or other information through the user interface.

Once user identification system 24 has determined that a user's profile is linked to a color modification regime and that color adjustments should be made, image modification system 22 may access the stored color adjustment instructions and implement the particular adjustments. Adjustments may be different for each color blind user, as users with different types and intensities of color blindness may respond to different color adjustments.

Rearview display assembly 28 may comprise a housing 44 and a mounting element 46 for mounting housing 44 to a vehicle. The mounting element 46 may be of any conventional type such as the type for attaching the rearview display assembly 28 to a windshield, roof, headliner, or overhead console of the vehicle, or to an exterior vehicle surface such as an exterior surface of a door. In some embodiments, at least some components of color modification system 10, such as PCB 36 and display element 34, may be mounted in housing 44 of rearview display assembly 28 or in mounting element 46, with appropriate connections made therebetween. Imager 38 may be capable of communicating, either directly or indirectly through image processing system, with display module 20 of rearview display assembly 28 to display modified or unmodified captured images on display element 34.

Display element 34 of display module 20 may be of various types including, but not limited to, a liquid crystal display (LCD), a light emitting diode (LED) display, an organic LED (OLED) display, or other display type suited for use inside a rearview display assembly 28.

Display module 20 in rearview display assembly 28 may have a variety of functions. For example, when used with a backup camera, display module 20 may cause a display showing a real-time panoramic view of the rear of the vehicle to appear on display element 34. The displayed image may appear in display element 34 automatically when the vehicle is shifted into reverse. In some embodiments, display may disappear when the vehicle is shifted into any gear other than reverse, and rearview display assembly 28 may revert to a mirror mode. Display module 20 may also provide vehicle or environmental information to a user, such as compass headings and blind spot warnings. In some embodiments, display module 20 may be capable of including additional content. The additional content may include, for example, a graphical overlay, line(s) representative of a trajectory of a vehicle, turn-by-turn directions, and driver assist features such as lane departure warnings.

Figure 3:
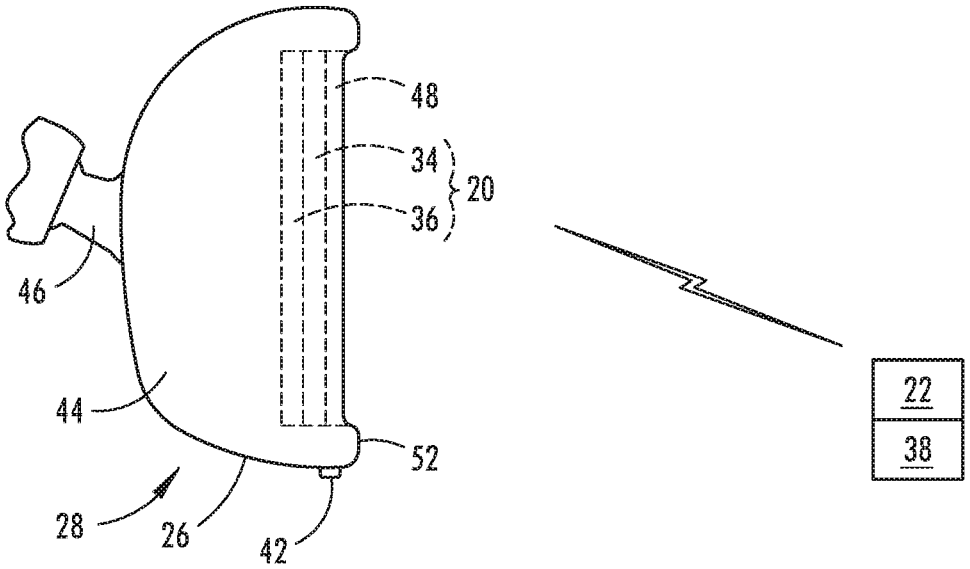
FIG. 3 illustrates a side view of the color modification system disposed in a rearview assembly in accordance with an embodiment of this disclosure.

In some embodiments, rearview display assembly 28 may further include a mirror element as shown in FIG. 3, which may be embodied as an electrochromic (EC) or electro-optic (EO) mirror element 48, a prismatic mirror element, or other element known to those with skill in the art. An EC or EO mirror element 48 may be characterized by having selectively high transmission, such as a dimmable mirror assembly. Rearview display element 34 may be viewed through EC or EO mirror element 48, and the EC or EO mirror element 48 may be disposed between display element 34 and the user. When an EC or EO mirror element 48 is activated, the electrochromic medium may darken or may change from a colorless medium to a colored medium, thereby altering the apparent color and color intensity of images displayed on display element 34 behind it. Accordingly, it may be advantageous to provide additional modifications to further adjust the hues and color intensities of the displayed image to compensate for any coloration or darkening imparted to the image by the electrochromic medium, and to achieve optimum clarity for users. Thus, in some embodiments, image processing system 22 may be capable of receiving inputs regarding the operation of EC or EO elements 48 associated with display module 20 of color modification system 10, and to further modify the image to correct for the effects of the EC or EO element 48. The further modifications may be directed toward modifying the colors or color intensities of images displayed through an EC or EO element 48 to conform with a color modification regime used for the user profile. Additionally or alternatively, in some embodiments, modifications due to color changes from the activation of EC or EO element 48 may be performed by imager 38 upon receipt of an appropriate signal.

Figure 5:
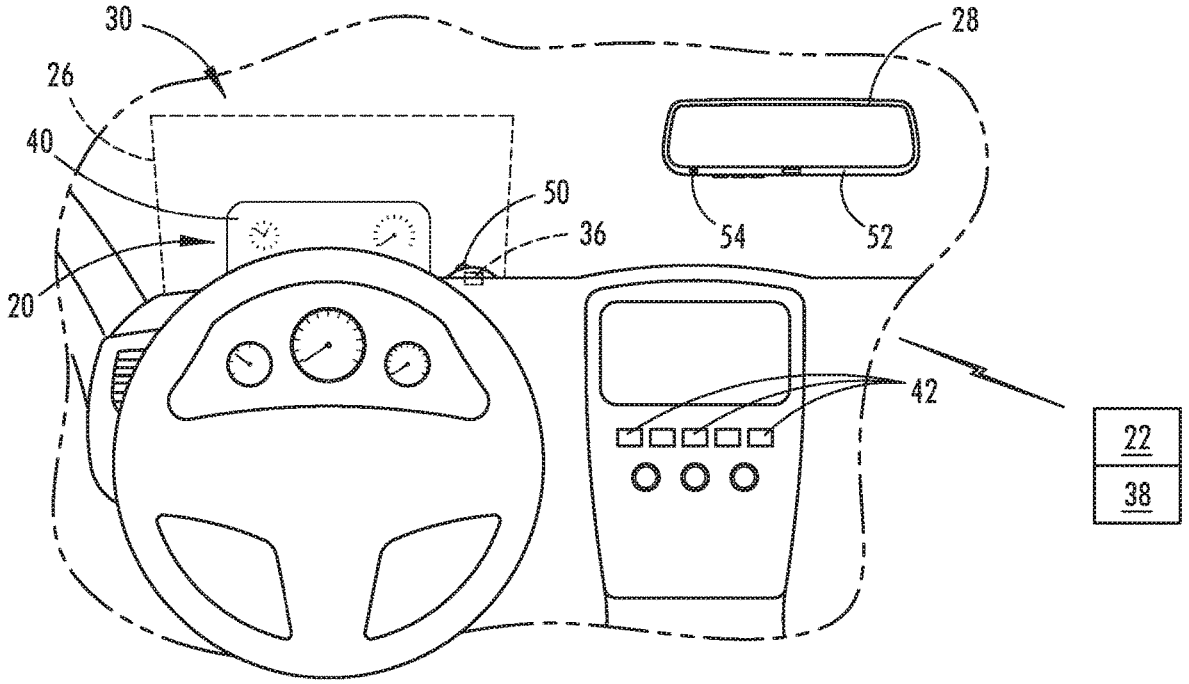
FIG. 5 illustrates the color modification system disposed in a heads up display system in accordance with an embodiment of this disclosure.

As shown in FIG. 5, in some embodiments, at least some components of color modification system 10 may be disposed in a heads-up display (HUD) system of a vehicle, shown generally at 30. With respect to FIG. 5, heads up display system 30 is depicted within a vehicle. It will be understood that while depicted within the vehicle, heads up display system 30 may equally be used in aerospace applications, window applications, transparency applications, augmented realty applications and other applications where a viewer may wish to see both information (e.g., vehicle related functions or driver assistance systems such as alerts, warnings or vehicle diagnostics) and what is behind HUD combiner screen 40. The HUD 30 may be used to display many vehicle related functions or driver assistance systems such as alerts, warnings or vehicle diagnostics. As an example, in FIG. 5, the speed of the vehicle is displayed on a display element in the form of a combiner screen 40 using an image of a speedometer. Combiner screen 40 may extend from an instrument panel and/or dashboard or be positioned directly on or integrated as part of a windshield of the vehicle. A projector 50 may be positioned proximate combiner screen 40 and capable of projecting images onto combiner screen 40 to form an image. The formed image may be reflected toward an intended viewer such as a driver or occupant of the vehicle.

In some embodiments, the color-modified HUD system 30 may comprise combiner screen 40, projector 50, image processing system 22, and user identification system 24. Color modified HUD system 30 may also comprise an imager 38. As in the previous discussion, image processing system 22 may modify images prior to displaying them. The modification may comprise selectively altering colors and color intensities of the displayed images. The modifications may be done based on inputs received from user identification system 24. Modifications applied to HUD systems 30 may also be applied to rearview display assemblies 28 and to infotainment console 32 displays. As with the rearview display assemblies, HUD system 30 may comprise an EC or EO element (not shown). HUD system 30 may be capable of receiving inputs regarding activation and darkening level of the EC or EO element and to further modify image to be displayed on combiner screen 40 accordingly.

Figure 4:
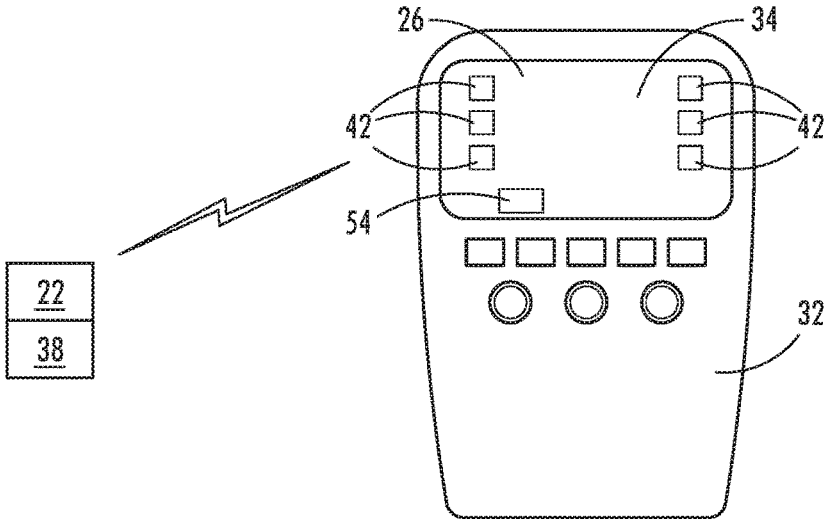
FIG. 4 illustrates the color modification system disposed in an infotainment console in accordance with an embodiment of this disclosure.

Referring now to FIG. 4, in some embodiments, at least some components of color modification system 10 may be disposed in an infotainment console 32 of a vehicle, shown generally at 32. Similar to rearview display assembly 28, infotainment console 32 may include a display module 20 comprising a display element 34. Display element 34 of infotainment console 32 may be of various types including, but not limited to, a liquid crystal display (LCD), a light emitting diode (LED) display, an organic LED (OLED) display, or other display type suited for use inside an infotainment console 32. Display module 20 may offer a variety of functions similar to those of rearview display assembly 28. For example, when used with a backup camera, display module 20 may cause a displayed image showing a real-time view of the rear of the vehicle to appear on display element 34. The displayed image may appear in display element 34 automatically when the vehicle is shifted into reverse. The displayed image may disappear when the vehicle is shifted into any other gear, and the display may revert to an infotainment mode. In some embodiments, display module 20 may be capable of displaying additional content such as, for example, turn-by-turn directions.

Vehicle infotainment console system 32 may further comprise an image processing system 22 and a user identification system 24. User identification system 24 may receive inputs and may use those inputs to identify a user and access the user's stored profile to determine whether the profile contains instructions to modify images displayed on infotainment system for that user. User identification system 24 may communicate information to image processing system 22. Image processing system 22 may modify images according to the stored modification regime linked to the user's stored profile prior to images being displayed on display element 34 of infotainment console 32.

Figure 7:
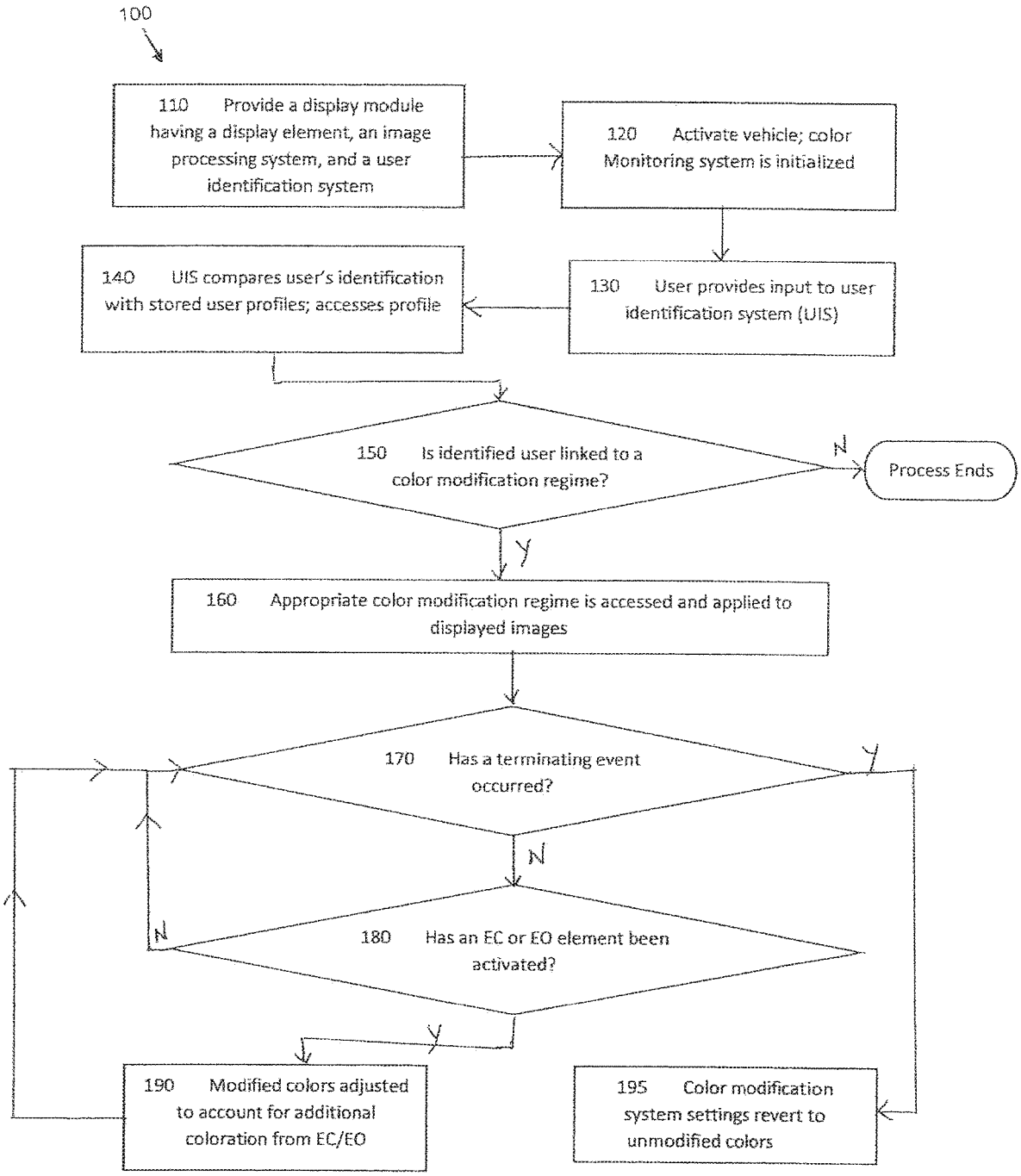
FIG. 7 is a flow chart showing the process steps for modifying colors in a vehicle display in accordance with an embodiment of this disclosure.
Figure 8:
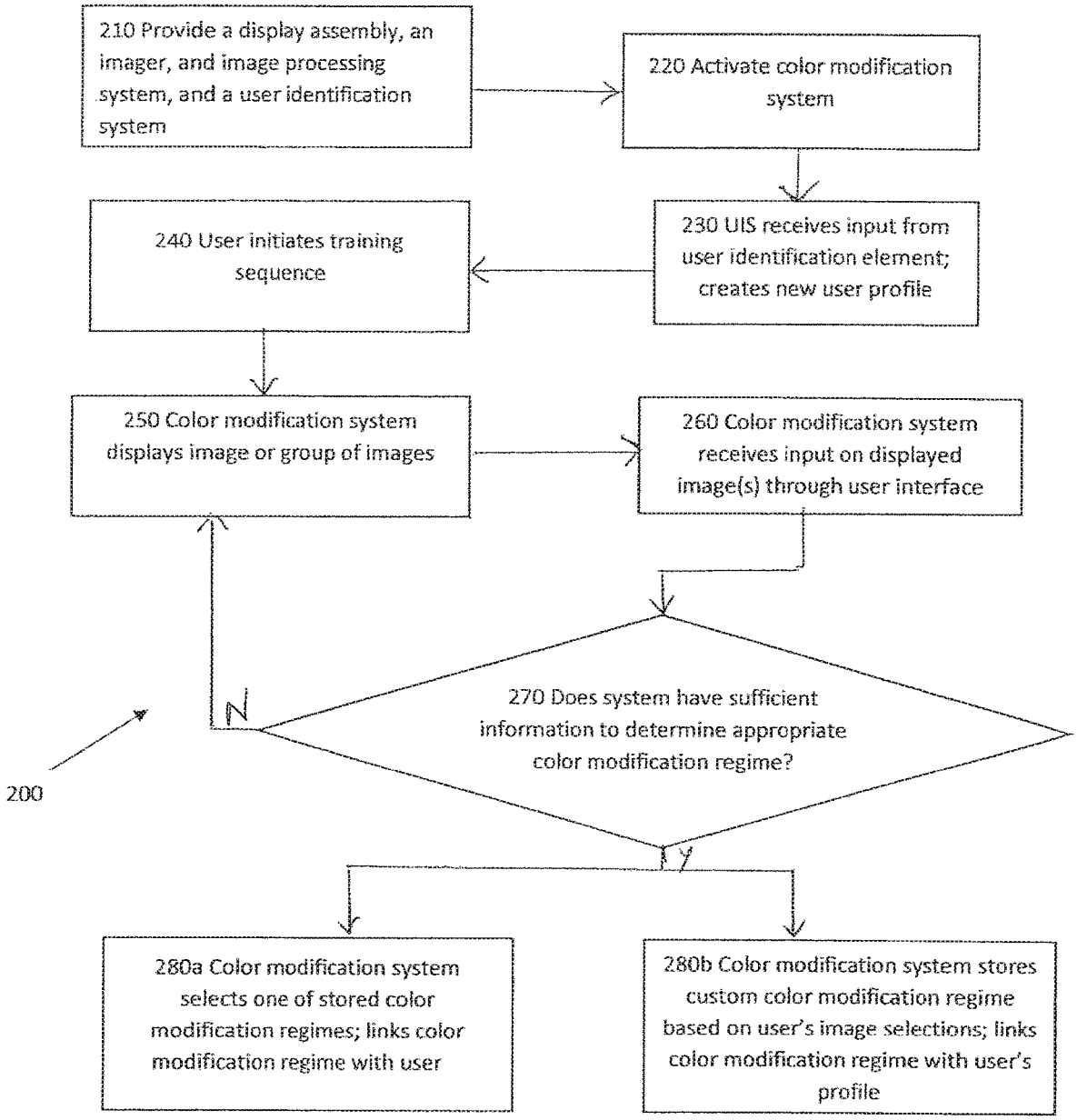
FIG. 8 is a flow chart showing the process steps for training the color modification system in accordance with an embodiment of this disclosure.

A method for activation and use of color modification system 10 is generally shown in FIG. 7 at 100. In a first step 110, color modification system 10 is provided. Color modification system 10 may comprise a display assembly 26, an imager 38, an image processing system 22, and a user identification system 24. Display assembly 26 may have a display module 20 comprising a display element 34. Imager 38 may be capable of capturing images of a desired area, and may be in communication with image processing system 22. Image processing system 22 may be capable of processing images captured by imager 38 and transmitting the images to display module 20 for display on display element 34. User identification system 24 may comprise a processor and a user identification element 54. User identification system 24 may be capable of identifying known users and linking them with stored profiles that include information on specific user settings. User identification element 54 may comprise at least one of an item controlled by a user and linked to the vehicle such as a key fob, a biometric recognition system such as a voice, body, face, iris, or fingerprint recognition system, or a user interface system that allows a user to enter a password or other identifying information.

In step 120, color modification system 10 may be activated and initialized. Imager 38 may capture images and transmit them to image processing system 22 for processing. In the initializing period, the hues and color intensities of images may not be modified. In step 130, user identification system 24 receives an input through user identification element 54. The input may be generated by proximity of an item controlled by the user such as a key fob, by a user entering a code or password through a user interface, or by biometric identification, such as fingerprint, voice, face, iris, or body recognition. In step 140, color modification system 10 may compare the input to data in stored user profiles. If the input matches data in a stored user profile, color modification system 10 may access the matching user profile. In step 150, color modification system determines whether the identified user's profile is linked to a color modification regime. If the user's profile is not linked to a color modification regime, color modification system 10 will not apply a stored color modification regime to the images to be displayed, and the process ends. In step 160, if the user's profile is linked to a color modification regime, the regime is applied to images to be displayed on display element 34. In step 170, color modification system 10 determines whether a terminating event has occurred. The terminating event may be an event that terminates the modification of images and causes color modification system 10 to revert to a neutral, unmodified display or turns off color modification system 10. The terminating event may be, for example, a user putting the vehicle into "Park" or turning off the vehicle. If no terminating event has occurred, in step 180, color modification system 10 determines whether an EC or EO element 48 associated with display element 34 has been activated. If one has not, color modification system 10 returns to step 150, and continues to apply an appropriate color modification regime. If an EC or EO element 48 associated with display element 34 has been activated, in step 190, color modification regime may be modified to account for color and color intensity changes due to the application of the EC or EO element 48. The modified color modification regime may compensate for any coloration or darkening of the image due to the activation of EC or EO element 48. In step 195, upon the occurrence of the terminating event, the settings of color modification system 10 revert to neutral settings in which colors are not modified.

Display assembly 26 may also have other functions occurring at the same time as color modification system 10 is active such as, for example, correcting for glare in display assembly 26. These functions may proceed even as color modification system 10 modifies colors of images.

Prior to a particular user using color modification system 10 for the first time, color modification system 10 may be trained to selectively modify images displayed in a display assembly 26 in response to the presence of the user. The training may comprise determining individualized modifications to be applied to images, or it may comprise selecting from a menu of predetermined color modification regimes. The modifications may be linked to a particular user, and the vehicle may recognize the user and apply the appropriate modifications to at least one display assembly 26 upon recognizing the user.

A method for training the color modification system 10 to recognize a particular user and apply a predetermined regime of color modifications is generally shown at 200 in FIG. 7. Method 200 starts with step 210, providing color modification system 10. Color modification system may comprise a display assembly 26 having a display module 20 comprising a display element 34, an imager 38 in communication with an image processing system 22, and a user identification system 24. Image processing system 22 may be capable of processing images captured by imager 38 and transmitting the images to display module 20 for display on display element 34. User identification system 24 may be capable of identifying known users and linking them with information or settings on the vehicle, and may comprise a user identification element 54. User identification element 54 may comprise at least one of an item controlled by a user and linked to the vehicle such as a key fob, a biometric recognition system such as a voice, body, face, iris, or fingerprint recognition system, or a user interface system that allows a user to enter identifying information.

In step 220, color modification system 10 may be activated, and may be initialized using unmodified colors in the displayed images. Color modification system 10 may be activated by, for example, the turning on of the vehicle. In step 230, user identification system 24 receives an input through user identification element 54. User identification system 24 may compare the input to information in stored user profiles. If there is no profile that matches the input, user identification system 24 may create a new user profile.

The training may commence in step 240. In some embodiments, the training may be initiated by vehicle identification of a new or unknown user. In some embodiments, a user may activate the training mode. This may be done by pressing a button, touching a touch capacitive sensor, or any other suitable means.

In step 250, color modification system 10 may display at least one image with a plurality of hues on display element 34. In some embodiments, color modification system 10 may simultaneously display at least two images of the same scene or graphic that differ only in colors and color intensities. The user may interact with color modification system 10 through a user interface. The user may, for example, select the image from a plurality of images that offers the user the best contrast and color palette. In step 260, color modification system 10 receives input from the user interface. The user interface may comprise interface elements such as buttons, toggles, switches, capacitive touch sensors 42, or other ways to interact with color modification system 10. Interface elements 42 may be disposed on rearview assembly 28, infotainment console 32, dashboard, instrument panel, or other easily-reached location within the vehicle.

After receiving the input from the user interface, in step 270, color modification system 10 may determine whether it has received sufficient information to determine an appropriate color modification regime. If it has not received sufficient information, color modification system 10 may return to step 250 and display a different image or group of at least two images and receive user input on the displayed image. After receiving user feedback on each image or group of images in step 260, color modification system 10 may determine, in step 270, whether it has sufficient information to determine an appropriate modification regime to use or whether it needs to present another image or group of images. In some embodiments, color modification system 10 may display a set number of images or pairs or groups of images and receive a user input on each image or image group. Once the set number of repetitions has been reached, color modification system 10 may have sufficient information to determine a color modification regime. In this case, determining whether there is sufficient information may involve simply determining whether the set number of repetitions has been reached.

Once an amount of inputs sufficient to allow color modification system 10 to determine an appropriate modification regime have been received, color modification system 10 may store details of the color modification regime and link those details with the identified user's profile.

When determining an appropriate color modification regime, color modification system 10 may either select from a group of stored color modification regimes or develop a custom color modification regime for the user based on user input. In some embodiments, in step 280*a*, color modification system 10 may have a plurality of stored modification regimes, and will select one to link with the user based on the user's choices during the training. In some embodiments, in step 280*b*, color modification system 10 may develop a custom regime for a user based on the user's choices during the training.

Once the system training has been completed, color modification system 10 may then apply the color modifications when color modification system 10 receives inputs that cause it to access the user's profile. In some embodiments, this may occur when the user is in the driver's seat of the vehicle. In some embodiments, color modification system 10 may require an affirmative action from the user prior to activating the color modifications. The affirmative action may be, for example, requiring a user to press a button to activate color modification system 10. Color modification system 10 may prompt user to press the appropriate button by displaying a reminder on display element 34 or combiner screen 40.

The above description is considered that of the preferred embodiments only. Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It should be noted that references to "front," "back," "rear," "upward," "downward," "inner," "outer," "right." and "left" in this description are merely used to identify the various elements as they are oriented in the FIGURES.

These terms are not meant to limit the element which they describe, as the various elements may be oriented differently in various applications.

It will be understood that any described processes or steps within described processes may be combined with other disclosed processes or steps to form structures within the scope of the present disclosure. Similarly, the method steps listed herein may be performed in any suitable order, and the order of the steps listed is not meant to limit the order in which the steps are to be performed. It should be understood that although the steps in FIG. x are shown as sequential, it is possible to alter the order of the steps or perform various steps in parallel without departing from the spirit of this disclosure.

The invention claimed is:

1. A color modification system for displays in vehicles comprising:

a display module comprising a display element capable of displaying color images;

an image processing system;

a display assembly having a housing;

an electro-optic element disposed between the display element and a user; and a user identification system in communication with the image processing system;

wherein the display module is at least partially housed in the housing;

wherein the display assembly comprises one of a rearview assembly, an infotainment console, and a heads up display system;

wherein the image processing system is in communication with the electro-optic element;

wherein the image processing system is capable of selectively modifying the colors of the images based on inputs received from the user identification system; and wherein the image processing system is capable of selectively applying additional modifications to images upon receiving inputs indicating that the electro-optic element has been activated.

2. The system of claim 1, wherein the image processing system is in communication with the display module.

3. The system of claim 1, wherein the user identification system is capable of providing inputs to the image processing system.

4. The system of claim 1, further comprising at least one imager capable of capturing color images and transmitting the color images to the image processing system.

5. The system of claim 1, further comprising a projector in communication with the image processing system;

wherein the display element comprises a combiner screen; and wherein the projector is capable of projecting the images onto the combiner screen.

6. The system of claim 1, wherein the user identification system comprises a processor and user identification element;

wherein the user identification system is capable of storing at least one user profile; and wherein the user identification element comprises at least one of an item controlled by a user and linked to the vehicle, a biometric recognition system, and a user interface system.

7. The system of claim 1, further comprising at least a second display module comprising at least a second display element;

wherein the at least a second display module is in communication with the image processing system;

wherein the user identification system is capable of providing inputs to the image processing system; and wherein the image processing system is capable of selectively modifying the colors of the images based on inputs received from the user identification system.

* * * * *